US010246211B2

(12) United States Patent
Lipp

(10) Patent No.: US 10,246,211 B2
(45) Date of Patent: Apr. 2, 2019

(54) CONTAINER PRODUCED FROM A HELICALLY BENT SHEET METAL STRIP

(71) Applicant: Xaver Lipp, Ellwangen (DE)

(72) Inventor: Xaver Lipp, Ellwangen (DE)

( * ) Notice: Subject to any disclaimer, the term of this patent is extended or adjusted under 35 U.S.C. 154(b) by 217 days.

(21) Appl. No.: 15/089,723

(22) Filed: Apr. 4, 2016

(65) Prior Publication Data

US 2016/0297559 A1 Oct. 13, 2016

(30) Foreign Application Priority Data

Apr. 8, 2015 (DE) ..... 10 2015 004 281

(51) Int. Cl.

| | |
|---|---|
| ***B65D 1/16*** | (2006.01) |
| ***B65D 90/02*** | (2019.01) |
| ***B65D 90/08*** | (2006.01) |
| ***E04H 7/06*** | (2006.01) |
| ***E04H 7/30*** | (2006.01) |
| ***B21C 37/12*** | (2006.01) |
| ***B65D 1/40*** | (2006.01) |

(52) U.S. Cl.

CPC ..... *B65D 1/165* (2013.01); *B21C 37/12* (2013.01); *B65D 1/40* (2013.01); *B65D 90/029* (2013.01); *B65D 90/08* (2013.01); *E04H 7/06* (2013.01); *E04H 7/30* (2013.01); *B21C 37/122* (2013.01)

(58) Field of Classification Search

CPC ..... B23K 9/0325; B21C 37/12; B65D 1/165; B65D 90/029; B65D 90/08; B65D 7/04; B65D 7/38; E04H 7/30

USPC ..... 220/608, 612; 228/145, 184

See application file for complete search history.

(56) References Cited

U.S. PATENT DOCUMENTS 2,216,606 A * 10/1940 Hall ..... B21C 37/122 228/145
2,751,672 A * 6/1956 Reed ..... B21C 37/12 220/565

(Continued)

FOREIGN PATENT DOCUMENTS

CA 2 241 354 A1 12/1999
DE 2 250 239 A 4/1974

(Continued)

OTHER PUBLICATIONS

European Search Report in EP 15003067.4-1604, dated Jan. 16, 2011.

*Primary Examiner* — Robert Poon
(74) *Attorney, Agent, or Firm* — Collard & Roe, P.C.

(57) ABSTRACT

A container is produced from a single-layered, helically bent sheet metal strip. In the strip's upper or lower border region a first helically running border portion of the strip is bent out via a helically running outwardly bent edge with a curved region toward the outside of the container as a protruding flange. A second helically running border portion is in the lower/upper border region. The border regions each border one another adjacently height-wise and are connected to one another in a fluid-tight manner via a continuous, helically running welded joint. The second border portion runs rectilinearly in the plane of the strip and the welded joint has a first and a second weld seam. The first and second weld seams are applied from the outside and the inside of the container, respectively, and the two weld seams are fused to each other in the weld route thereof.

11 Claims, 3 Drawing Sheets

(56) References Cited

U.S. PATENT DOCUMENTS 2,993,617 A * 7/1961 Briggs ..... B65D 90/042 220/567.3
3,078,818 A * 2/1963 Butler ..... B21C 37/122 228/145
3,380,147 A * 4/1968 McDonald ..... B21C 37/12 228/145
3,715,557 A * 2/1973 Netterstedt ..... B21C 37/12 219/62
3,735,478 A * 5/1973 Porter ..... B21C 37/122 228/144
3,789,181 A * 1/1974 Netterstedt ..... B21C 37/12 219/62
3,863,479 A 2/1975 Lipp
4,142,284 A * 3/1979 Steuber ..... B21C 37/12 29/417
4,429,654 A * 2/1984 Smith, Sr. ..... B21C 37/123 114/65 R
4,640,432 A * 2/1987 Tate, Jr. ..... F25D 23/065 220/612
4,817,817 A * 4/1989 Palazzo ..... B65D 90/029 220/560.03
6,187,395 B1 * 2/2001 Canzler ..... B23K 9/0253 228/184
6,732,906 B2 * 5/2004 Andersen ..... B21C 37/122 228/145
2015/0274352 A1 10/2015 Lipp

FOREIGN PATENT DOCUMENTS

DE 199 39 180 A1 2/2001
DE 20 2012 009 932 U1 11/2012
DE 10 2015 004 281 A1 12/2015
EP 1 181 115 B1 2/2002
GB 1 424 853 A 2/1976
SU 1152511 A 4/1985
WO 00/72991 A1 12/2000
WO 2014/048515 A1 4/2014

* cited by examiner

CONTAINER PRODUCED FROM A HELICALLY BENT SHEET METAL STRIP

CROSS REFERENCE TO RELATED APPLICATIONS

Applicant claims priority under 35 U.S.C. § 119 of German Application No. 10 2015 004 281.5 filed Apr. 8, 2015, the disclosure of which is incorporated by reference.

BACKGROUND OF THE INVENTION

1. Field of the Invention

The present invention relates to a container produced from a single-layered, helically bent sheet metal strip, in the upper or in the lower border region of the sheet metal strip a first helically running border portion of the sheet metal strip being bent out via a helically running outwardly bent edge with a curved region toward the outside of the container as a protruding flange, there being a second helically running border portion in the lower/upper border region of the sheet metal strip, and the helically running border regions of the sheet metal strip, which each border one another in a manner adjacent in terms of height, being connected to one another in a fluid-tight manner via a continuous, helically running welded joint.

2. Prior Art

Containers produced from helically bent sheet metal strip are known from DE 2 250 239 A or EP 1 181 115 B1. In order to produce containers, a coil with a diameter corresponding to the container diameter is shaped here from a sheet metal strip. During the production of a container of this type, the mutually assigned coil sheet metal strip borders are first of all bent out and are subsequently connected to one another in a fluid-tight manner on the outside of the container by means of a seam. For this purpose, the mutually opposite longitudinal edges of the sheet metal strip are each bent out in a U-shaped manner and the mutually assigned sheet metal borders bent out in a U-shaped manner are placed one inside another and are subsequently connected by seaming. This system is commercially known as the Lipp dual-seam system and has proven successful in diverse situations. By means of said Lipp dual-seam system, simple and rapid production of the containers with a variable diameter and variable height is possible. Transportable sheet metal bending and installation apparatuses ensure that the container can be installed at the respective erection site and the transport volume can be corresponding reduced.

It is known from DE 199 39 180 A1 to produce a container in such a manner that a first border portion is bent out toward the outside, forming a helically running outwardly bent edge, and a second border portion of the sheet metal strip, which is arranged adjacently thereabove, is bent over outward and is then connected to a first border portion by a seam.

For the previous applications of said container system, for example for storing bulk materials from agriculture and forestry, or biowaste, the containers have excellent stability, tightness and media resistance. However, for further applications, such as, for example, the storage of fluid media, such as vegetable oils, natural oil or the like, a significantly larger container volume is required, and in which applications the tightness has to be reliably ensured. The associated increased mechanical stability of the containers cannot be adequately ensured by the known seam systems. In particular, the seam system reaches its limits in the event of great sheet metal thicknesses.

In order to provide containers which are produced helically from bent sheet metal strip and the range of application of which is increased, in particular with regard to the realization of a large storage volume and/or increased mechanical stability while ensuring nevertheless simple and rapid production capability and installation, solutions have been developed which replace the seam connection with a welded joint.

WO 2014/048515 A1 discloses a container produced from a helically bent sheet metal strip of the type described at the beginning, wherein the border portions of the adjacent border regions, which run one above another in terms of height, of the sheet metal strip are connected to one another via a welded joint. The border regions overlap here and are connected to one another in a fluid-tight manner by means of two separate weld seams. The distance present between the weld seams gives rise, in the overlapping region of adjacent border regions of the sheet metal strip, to a gap region between the overlapping walls, which gap region is not controllable in a simple manner with respect to possible risks of corrosion or the like after the container has been produced.

SUMMARY OF THE INVENTION

Starting from the prior art mentioned with regard to the welded design, the present invention is based on the object or the technical problem of providing a container which further increases the range of application of containers of this type, in particular ensures the same while retaining the economic production capability in situ by means of helical sheet metal strips, and which has wall thicknesses which cannot be realized by the known seam methods, meets very exactly requirements with regard to purity, media resistance and tightness, and ensures a permanently reliable operation and permits container sizes to be realized with regard to diameter and height that could not be realized hitherto.

These and other objects are achieved by a container according to the invention.

Advantageous refinements and developments are set forth below.

Accordingly, the container according to the invention of the type mentioned at the beginning is distinguished in that the second border portion of the sheet metal strip runs rectilinearly in the plane of the sheet metal strip, the welded joint has a first and a second weld seam, the first weld seam, which is preferably produced first of all, being fused from the outside of the container to the outer-side wall of the second border portion and the wall of the curved region, the second weld seam, which is preferably produced subsequently, being fused from the inside to the end surface of the second border portion of the sheet metal strip, and the weld routes of the first and second weld seam being fused to each other such that there is a homogeneous fully fused welded joint running from the outside to the inside.

During the production of the welded joint, preferably the first weld seam is applied first of all from the outside and then the second weld seam is applied from the inside.

However, it is also possible to apply the second weld seam first of all from the inside and then to apply the first weld seam from the outside.

Alternatively, the two weld seams can also be applied simultaneously.

A particularly advantageous refinement ensuring high stability is distinguished in that the height level of the upper border of the first border portion and the height level of the end surface of the second border portion is substantially identical with regard to border regions of the sheet metal strip that are arranged adjacent in terms of height.

Alternatively, an advantageous refinement is distinguished in that the height level of the upper border of the first border portion and the height level of the end surface of the second border portion has a distance upward in terms of height with respect to border regions of the sheet metal strip that are arranged adjacent in terms of height.

A further advantageous refinement, by means of which an advantageous, continuous welded joint is made possible with little material consumption, is distinguished in that the height level of the upper border of the first border portion and the height level of the end surface of the second border portion has a distance downward in terms of height with respect to border regions of the sheet metal strip that are arranged adjacent in terms of height.

In respect of the practical realization, a particularly advantageous refinement with respect to production and ensuring simple production and a reliable homogeneous welded joint has proven advantageous to form said joint in such a manner that the distance downward lies within the range of between 50% and 100% of the sheet metal thickness of the sheet metal strip or alternatively the distance upward lies within the range of between 50% and 200% of the sheet metal thickness of the sheet metal strip.

A variant embodiment which is particularly simple in practice and can be implemented reliably is distinguished in that the width of the first weld seam lies within the range of between 100% and 200% of the sheet metal thickness of the sheet metal strip, and/or the width of the second weld seam lies within the range of between 100% and 300% of the sheet metal thickness of the sheet metal strip.

With regard to an economic and reliable implementation, a variant embodiment has proven advantageous in which the radius of the curved region lies within the range between 2 mm and 20 mm, as a result of which the range can easily be met for the increased requirements in the case of containers with a large diameter and high carrying loads.

A particularly preferred refinement which ensures a "smooth" inner surface of the container is distinguished in that the second border portion and the third border portion lie in the center plane of the sheet metal strips arranged in each case one above another in terms of height, and therefore a smooth inner surface is ensured within the proportion of the container, said inner surface, because of the welded joint provided, having high strength and not having any edges present on the inner side at which filling material may accumulate.

A particularly preferred development which ensures high rigidity in the region of the joint is distinguished in that the curved region of the outwardly bent edge has an increased radius and the curved region forms a convex region which protrudes toward the inside and then merges into the projecting first border portion.

The container according to the invention is distinguished in the simplest manner in that a welded joint is provided in the region of the connection of border regions of the sheet metal region, which border regions are adjacent one above the other in terms of height, said welded joint having a homogeneous structure and reliably connecting the bordering border regions to one another without—as in the prior art—there being gap regions between the border regions that contain potential with respect to possible risks of corrosion. The homogeneous penetration welding in the border region of sheet metal strips bordering one another ensures a high load-bearing capacity and a permanently reliable operation.

At the same time, the design according to the invention permits the production of containers with great wall thicknesses in order to be able economically to realize containers with large dimensions, maintaining the welded joint principle for the borders of a helically running sheet metal strip.

Further embodiments and advantages of the invention emerge from the features furthermore cited in the claims and from the exemplary embodiments indicated below. The features of the claims can be combined with one another in any manner unless they clearly mutually exclude one another.

BRIEF DESCRIPTION OF THE DRAWING

The invention and advantageous embodiments and developments of same are described and explained in more detail below with reference to the examples illustrated in the drawing. The features which can be gathered from the description and the drawing may be used, according to the invention, individually on their own or more than one together in any combination. In the drawing.

WAYS OF IMPLEMENTING THE INVENTION

Figure 1:
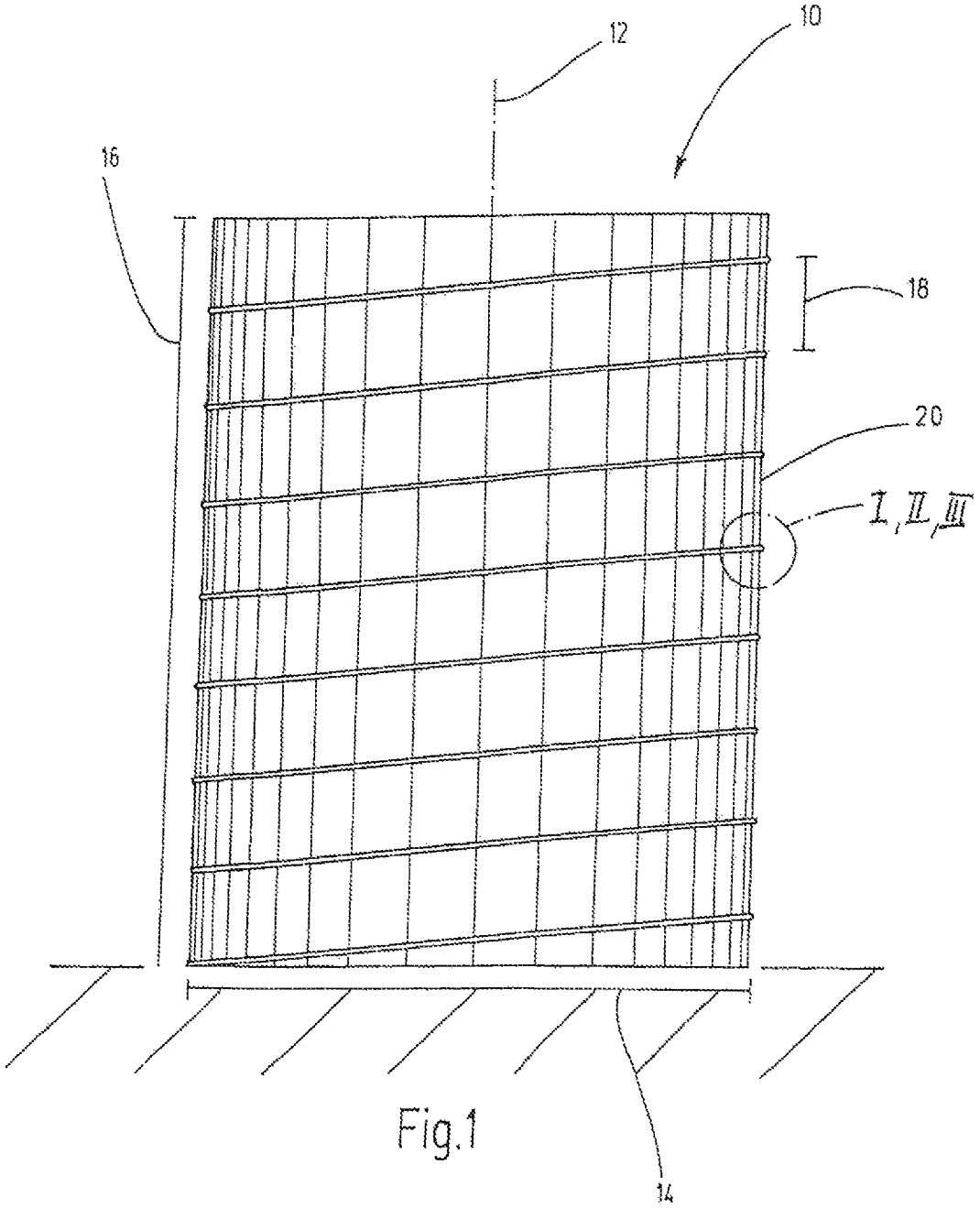
FIG. 1 shows a side view of a container according to the invention.

FIG. 1 shows a view of at container 10 according to the invention as may be used for storing bulk materials from agricultural and forestry, for example cereals, wood chips or biowaste, or for storing water, wastewater or sewage sludge, or else for storing gas or natural oil. The container 10 is substantially cylindrical, in particular circular-cylindrical, on the outside thereof and the inside thereof, with a vertically oriented longitudinal axis 12.

The production of the container 10 takes place, preferably directly at the erection site of the container 10, using a helically bent sheet metal strip 20. The diameter 14 of the container 10 may be between 4 m and 20 m or more. The height 16 of the container 10 may be between 2 m and 20 m or more. The capacity of the container 10 may be, for example, between 15 $m^3$ and 8000 $m^3$. The preferably homogeneous thickness 50 (FIG. 2) of the sheet metal strip 20 is between 2 mm and 12 mm, in the present case may in particular be more than 5 mm, preferably more than 6 mm and less than 12 mm, for example between 8 mm and 10 mm. The width 18 of the sheet metal strip 20 may be between 20 cm and 100 cm, in particular between 30 cm and 80 cm and preferably between 40 cm and 60 cm; in the exemplary embodiment illustrated, the width 18 of the sheet metal strip 20 is approximately 50 cm.

Figure 2:
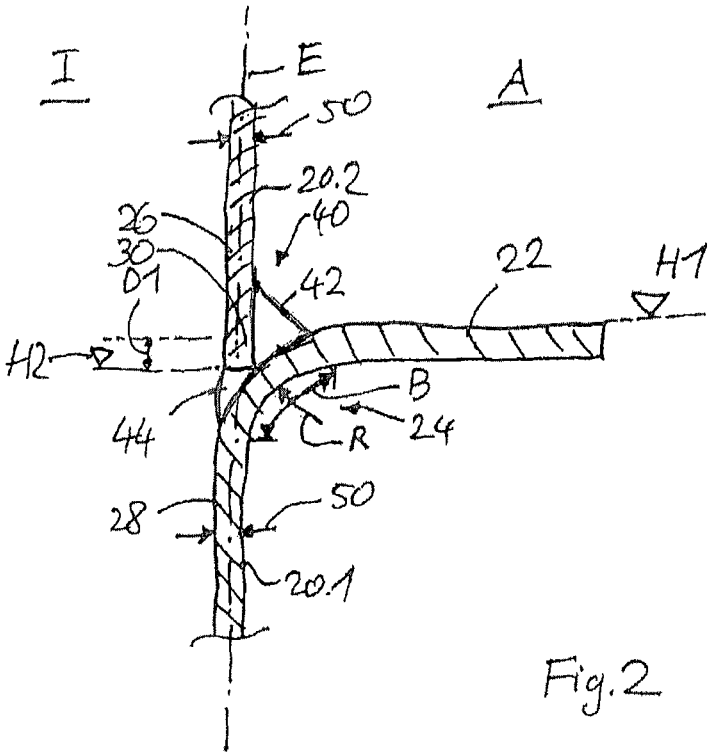
FIG. 2 shows an enlarged illustration of a cross section through the connecting point between border regions, which are adjacent in terms of height, of the sheet metal strip according to detail I from FIG. 1, in a first exemplary embodiment.

FIG. 2 illustrates the detail I from FIG. 1 in the connecting region. The outside of the container 10 is identified by the reference sign A and the inside by the reference sign I. The upper border region of a lower sheet metal strip 20.1 and of an upper sheet metal strip 20.2, which is adjacent vertically on the upper side, is illustrated in each case. The two sheet metal strips 20.1, 20.2 are arranged running helically in a plane E, wherein the plane E is the center plane of the container 10. The lower sheet metal strip 20.1 has a first border portion 22 which is bent out toward the outside via an outwardly bent edge 24 and forms a protruding flange. In the region of the outwardly bent edge 24, there is a curved region B with a bending radius R which is adjoined by a third border portion 28 of the lower sheet metal strip 20.1, which lies in the plane E. The size of the radius R may be within the range of between 2 mm and 10 mm or more.

The first border portion 22 is present substantially at a right angle to the third border portion 28. The first border portion 22 likewise runs helically. The respective height level of the first border portion 22 is identified in FIG. 2 by the arrow tip H1.

A second border portion 26 of the upper sheet metal strip 20.2, which border portion runs rectilinearly in the plane E, is present adjacent upward in the vertical direction. The lower-side end surface 30 of the second border portion 26 of the upper sheet metal strip 20.2 is arranged in a height level H2, wherein the height level H2 runs in the vertical direction at a distance D1 below the height level H1. The right edge of the end surface 30 bears on the upper side against the curved region B. In the exemplary embodiment illustrated, the distance D1 between the height level H1 and the height level H2 substantially corresponds to the sheet metal thickness 50.

The connection of the upper sheet metal strip 20.2 to the lower sheet metal strip 20.2 takes place via a helically running welded joint 40.

The welded joint 40 here comprises a first weld seam 42 which is applied first of all from the outside A and by means of which the outside of the second border portion 26 of the upper sheet metal strip 20.2 is fused to the upper side of the curved region B of the lower sheet metal strip 20.1. Furthermore, there is a second weld seam 44 which is applied from the inside I after the first weld seam 42 has been applied and which is fused to the end surface 30 of the second border portion 26 of the upper sheet metal strip 20.2 and the upper side of the curved region B of the lower sheet metal strip 20.1. During the welding, the weld routes of the first and second weld seam 42, 44 are also fused to each other, and therefore a welded joint 40 which is continuously homogeneous from the outside inward and has a high load-bearing capacity is present. At the same time, absolute seal tightness is ensured.

It is also possible to apply the second weld seam 44 first of all from the inside I and then to apply the first weld seam from the outside A.

In an alternative manner of production, the first and second weld seam 42, 44 are applied simultaneously.

Figure 3:
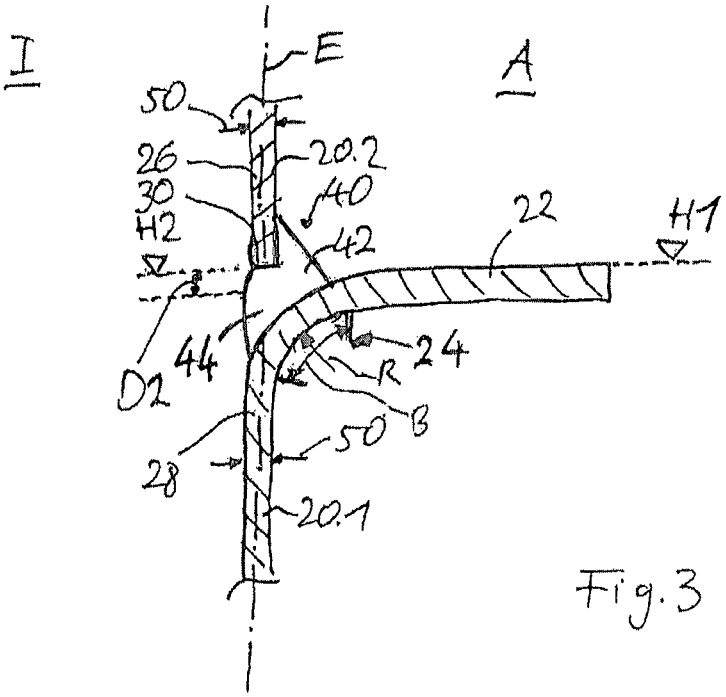
FIG. 3 shows an enlarged illustration of a cross section through the connecting point between border regions, which are adjacent in terms of height, of the sheet metal strip according to detail II from FIG. 1, in a second exemplary embodiment.

FIG. 3 illustrates a second exemplary embodiment of the connecting structure of a lower border region of an upper sheet metal strip 20.2 to the upper border region of a lower sheet metal strip 20.1, wherein the sheet metal strips 20.1, 20.2 have the same geometry as the sheet metal strips 20.1, 20.2 illustrated in FIG. 2. Identical components bear the same reference signs and are not explained once again.

The difference over FIG. 2 consists in that the upper sheet metal strip 20.2 or the lower end surface 30 thereof is arranged at a height level H2 which runs at a distance D2 above the height level H1 of the upper side of the first border portion 22 of the lower sheet metal strip 20.1. In the exemplary embodiment, the distance D2 substantially corresponds to the sheet metal thickness 50. By means of the geometrical arrangement, it is possible to apply a welded joint to the first weld seam 42 and the second weld seam 44 that has an increased weld seam thickness, which permits a particularly high load-bearing capacity of the welded joint construction while simultaneously ensuring absolute seal tightness.

In the exemplary embodiments according to FIG. 2 and FIG. 3, it is also possible for the second weld seam 44 to be applied in such a manner that it is fused not only to the end surface 30 of the second border portion 26 of the upper sheet metal strip 20.2, but is also fused to the lower border region of the inner wall of the second border portion 26.

Figure 4:
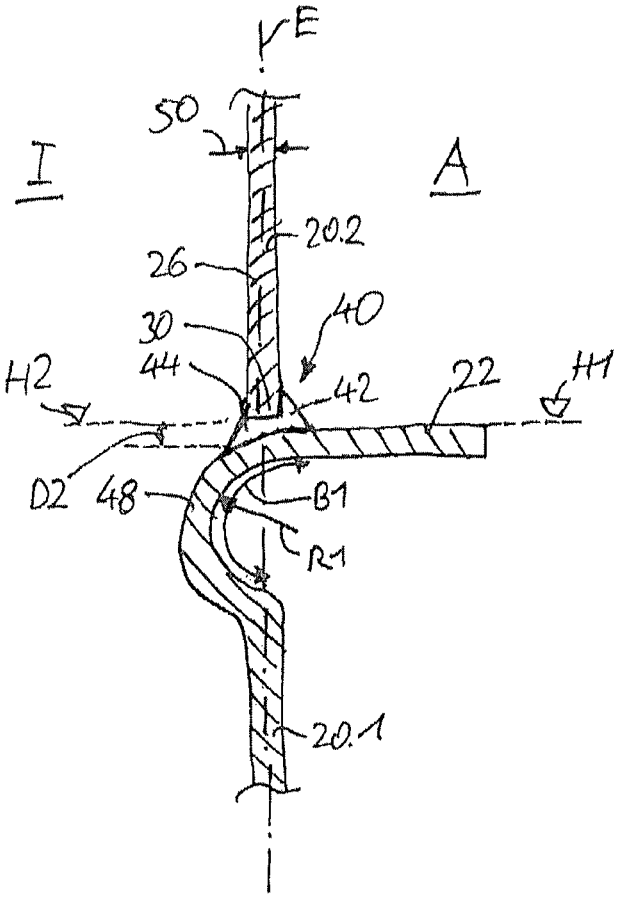
FIG. 4 shows an enlarged illustration of a cross section through the connecting point between border regions, which are adjacent in terms of height, of the sheet metal strip according to detail III from FIG. 1, in a third exemplary embodiment.

FIG. 4 illustrates a third exemplary embodiment according to detail III from FIG. 1 in the connecting region between an upper and a lower sheet metal strip 20.1, 20.2, in which the basic arrangement of the lower sheet metal strip and of the upper sheet metal strip corresponds to the arrangement according to the exemplary embodiments of FIG. 3, but with the difference that, in the region of the outwardly bent edge 24, the radius R1 of the curved region B1 is substantially increased, and the curved region B1 has a convex region 48 which protrudes toward the inside I and on the lower end region of which the third border portion 28.1 is integrally formed and in the upper end region of which the second border portion 22 (protruding flange) is integrally formed. The height level H2 of the end surface 30 of the second border portion 26 of the upper sheet metal strip 20.2 is arranged offset upward by the distance size D2 in relation to the height level H1 of the upper side of the first border portion 22 of the lower sheet metal strip 20.1. The connection of the two border regions of the sheet metal strips 20.1, 20.2 also takes place via a welded joint 40 with a first weld seam 42 which is applied from the outside A and with a second weld seam 44 which is applied from the inside.

Here too, the first weld seam 42 is fused to the lower border region of the second border portion 26 of the upper sheet metal strip 20.2 and on the upper side to the end region of the curved region B1, the second weld seam 44 is fused in the lower border region to the inside I of the second border portion 26 and in regions to the upper side of the curved region B1, and at the same time the weld routes of the two weld seams 42, 44 are fused to each other and at the same time the end surface 30 and the upper-side region of the curved region B1, which upper-side region is opposite the end surface 30, are fused.

The rigidity in the region of the connecting structure is increased by the inwardly protruding convex region 48 of the curved region B1. Also in this embodiment, there is a welded joint 40 which is fully fused from the outside A to the inside I and which ensures high load-bearing capacity with simultaneously absolute tightness.

What is claimed is:

1. A container comprising:

a single-layered, helically bent sheet metal strip having an upper border region and a lower border region;

a first helically running border portion in the upper border region or the lower border region of the single-layered, helically bent sheet metal strip, wherein the first helically running border portion is bent out via a helically running outwardly bent edge with a curved region toward an outside of the container as a protruding flange;

a second helically running border portion in the upper border region or the lower border region of the single-layered, helically bent sheet metal strip, wherein the second helically running border portion runs rectilinearly in a plane of the single-layered, helically bent sheet metal strip;

wherein the first helically running border portion and the second helically running border portion each border one another in a manner adjacent in terms of height;

a continuous, helically running welded joint connecting the first helically running border portion and the second helically running border portion in a fluid-tight manner, the continuous, helically running welded joint comprising a first weld seam and a second weld seam;

wherein the first weld seam is fused from the outside of the container to an outer-side wall of the second helically running border portion and a wall of the curved region;

wherein the second weld seam is fused from an inside to an end surface of the second helically running border portion; and wherein a first weld route of the first weld seam and a second weld route of the second weld seam are fused to each other such that a homogeneous fully fused welded joint runs from the outside to the inside.

2. The container as claimed in claim 1, wherein a height level of an upper border of the first helically running border portion and a height level of the end surface of the second helically running border portion are substantially identical with regard to border regions of the sheet metal strip that are arranged adjacent in terms of height.

3. The container as claimed in claim 1, wherein a height level of an upper border of the first helically running border portion and a height level of the end surface of the second helically running border portion have a distance upward in terms of height with respect to border regions of the sheet metal strip that are arranged adjacent in terms of height.

4. The container as claimed in claim 1, wherein a height level of an upper border of the first helically running border portion and a height level of the end surface of the second helically running border portion have a distance downward in terms of height with respect to border regions of the sheet metal strip that are arranged adjacent in terms of height.

5. The container as claimed in claim 3, wherein the distance lies within a range of between 50% and 100% of a sheet metal thickness of the sheet metal strip.

6. The container as claimed in claim 4, wherein the distance lies within a range of between 50% and 100% of a sheet metal thickness of the sheet metal strip.

7. The container as claimed in claim 1, wherein a width of the first weld seam lies within a range of between 100% and 200% of a sheet metal thickness of the sheet metal strip.

8. The container as claimed in claim 1, wherein a width of the second weld seam lies within a range of between 100% and 300% of a sheet metal thickness of the sheet metal strip.

9. The container as claimed in claim 1, wherein a bending radius of the curved region of the outwardly bent edge lies within a range of between 2 mm and 20 mm.

10. The container as claimed in claim 1, wherein the second helically running border portion and a third border portion of the sheet metal strip, which third border portion is adjacent to the curved region, lie in a plane with respect to the sheet metal strip which border one another adjacently in terms of height.

11. The container as claimed in claim 1, wherein the curved region of the outwardly bent edge has an increased radius and the curved region forms a convex region protruding toward the inside.

* * * * *